US011291346B2

(12) United States Patent
Heiligenmann et al.

(10) Patent No.: US 11,291,346 B2
(45) Date of Patent: Apr. 5, 2022

(54) DEVICE, WATER-CONDUCTING HOUSEHOLD APPLIANCE AND METHOD FOR CUSTOMIZING A WASHING PROGRAM

(71) Applicant: BSH Hausgeräte GmbH, Munich (DE)

(72) Inventors: Caroline Heiligenmann, Böblingen (DE); Matthias Arnold, Lauingen (DE); Ersin Isbilen, Lauingen (DE)

(73) Assignee: BSH Hausgeräte GmbH, Munich (DE)

( * ) Notice: Subject to any disclaimer, the term of this patent is extended or adjusted under 35 U.S.C. 154(b) by 432 days.

(21) Appl. No.: 16/324,949

(22) PCT Filed: Aug. 10, 2017

(86) PCT No.: PCT/EP2017/070331
§ 371 (c)(1),
(2) Date: Feb. 12, 2019

(87) PCT Pub. No.: WO2018/046223
PCT Pub. Date: Mar. 15, 2018

(65) Prior Publication Data

US 2021/0282620 A1 Sep. 16, 2021

(30) Foreign Application Priority Data

Sep. 7, 2016 (DE) ..... 10 2016 217 011.2

(51) Int. Cl.
*A47L 15/00* (2006.01)
*A47L 15/42* (2006.01)

(52) U.S. Cl.
CPC ..... *A47L 15/0028* (2013.01); *A47L 15/0055* (2013.01); *A47L 15/4217* (2013.01); (Continued)

(58) Field of Classification Search
CPC ..... A47L 15/00–508; A47L 2501/07
See application file for complete search history.

(56) References Cited

U.S. PATENT DOCUMENTS 4,070,204 A * 1/1978 Hardy ..... A47L 15/0023 134/25.2
2004/0119972 A1 6/2004 Smit-Kingma et al.
(Continued)

FOREIGN PATENT DOCUMENTS

CN 2795254 Y 7/2006
CN 101812786 A 8/2010
(Continued)

OTHER PUBLICATIONS

JP2014014561A Machine Translation (Year: 2014).*
(Continued)

*Primary Examiner* — Spencer E. Bell
(74) *Attorney, Agent, or Firm* — Michael E. Tschupp; Andre Pallapies; Brandon G. Braun

(57) ABSTRACT

A device for customizing a washing program for removing soiling from items being washed in a water-conducting household appliance includes a sensor configured to acquire spectral measurement values of organic compounds in washing water in the water-conducting household appliance. A determination unit determines functional groups of the organic compounds based on the acquired spectral measurement values of the organic compounds, and a customization unit customizes washing parameters of a current washing program based on the determined functional groups.

21 Claims, 4 Drawing Sheets

(52) U.S. Cl.
CPC ..... *A47L 15/4297* (2013.01); *A47L 2401/10* (2013.01); *A47L 2401/30* (2013.01); *A47L 2501/07* (2013.01); *A47L 2501/30* (2013.01)

(56) References Cited

U.S. PATENT DOCUMENTS

| | | | | |
|---|---|---|---|---|
| 2006/0037632 | A1 | 2/2006 | Nito | |
| 2006/0201537 | A1 | 9/2006 | Carlhoff | |
| 2009/0314313 | A1* | 12/2009 | Classen | A47L 15/0055 134/25.2 |
| 2012/0291808 | A1* | 11/2012 | Monsrud | B08B 3/02 134/18 |
| 2018/0156725 | A1 | 6/2018 | Kessler et al. | |

FOREIGN PATENT DOCUMENTS

| | | | | |
|---|---|---|---|---|
| CN | 102414358 | A | | 4/2012 |
| CN | 102720034 | A | | 10/2012 |
| JP | 2002300995 | A | * | 10/2002 |
| JP | 3545356 | B2 | | 7/2004 |
| JP | 2014014561 | A | | 1/2014 |

OTHER PUBLICATIONS

JP2002300995A Machine Translation (Year: 2002).*
International Search Report PCT/EP2017/070331 dated Oct. 20, 2017.
National Search Report DE 10 2016 217 011.2 dated Mar. 30, 2017.
National Search Report CN 201780054708.7 dated Jun. 10, 2021.
National Search Report CN 201780054708.7 dated Dec. 25, 2020.

* cited by examiner

DEVICE, WATER-CONDUCTING HOUSEHOLD APPLIANCE AND METHOD FOR CUSTOMIZING A WASHING PROGRAM

CROSS-REFERENCES TO RELATED APPLICATIONS

This application is the U.S. National Stage of International Application No. PCT/EP2017/070331, filed Aug. 10, 2017, which designated the United States and has been published as International Publication No. WO 2018/046223 A1 and which claims the priority of German Patent Application, Serial No. 10 2016 217 011.2, filed Sep. 7, 2016, pursuant to 35 U.S.C. 119(a)-(d).

BACKGROUND OF THE INVENTION

The present invention relates to a device and method for customizing a washing program for removing soiling from items being washed in a water-conducting household appliance, for example a dishwasher. The invention also relates to a water-conducting household appliance with such a device.

In water-conducting household appliances, such as dishwashers for example, a universal washing program is generally used, comprising a number of washing program segments. These washing program segments are each optimized for different types of soiling that may potentially be present. However if not all the potential types of soiling are present, the universal washing program is unnecessarily long and consumes an unnecessarily large quantity of energy and washing agent or rinse aid.

In order to customize such a universal program for current soiling, it is possible to react to differences in the quantity and kinetics of the soiling with the aid of sensors, referred to as turbidity sensors. The temperature and duration of the washing program can be customized based on the turbidity detected. However no information is provided with regard to the specific nature of the individual components of the soiling. Also the turbidity sensor only comes into operation when the soiling has already been removed from the items being washed. This means that such customization does not always produce the desired cleaning result for the user.

BRIEF SUMMARY OF THE INVENTION

Against this background one object of the present invention is to improve the customization of a washing program in a water-conducting household appliance.

A device for customizing a washing program for removing soiling from items being washed in a water-conducting household appliance is therefore proposed. The device has a sensor for acquiring spectral measurement values of organic compounds in the washing water in the water-conducting household appliance, a determination unit for determining functional groups of the organic compounds based on the acquired spectral measurement values of the organic compounds and a customization unit for customizing washing parameters of a current washing program based on the determined functional groups.

The device not only detects the turbidity of the washing water, it also determines the individual components within the washing water, in other words the organic compounds in the washing water. The detected organic compounds are also divided into functional groups. The functional groups can be acquired when the items being washed are still soiled. Acquisition of the functional groups can also include acquisition of the concentration of the respective functional group and/or a change in concentration.

The determination is performed indirectly in the washing liquor here. The soiling on the items being washed is determined indirectly by components in the washing water. The device therefore serves to determine the removal rate for soiling, in other words to determine how much and what soiling is removed from the items being washed.

The proposed device allows better detection in respect of the nature, quantity and kinetics of the soiling on items being washed in a water-conducting household appliance. This allows optimized cleaning with optimized conservation of resources for the user of the water-conducting household appliance.

A water-conducting household appliance in this context can refer for example to a dishwasher with dishes as the items being washed or a washing machine with laundry as the items being washed.

The sensor serves to detect organic compounds in the soiling. The determination unit then determines the functional groups contained in the organic compounds. A functional group refers to the groups of atoms in organic compounds, which essentially determine the material properties and reaction response of the compounds containing them. Functional groups are classified based on the atoms involved as functional groups with heteroatoms (e.g. ether) and those without heteroatoms (e.g. C═C double bonds, CEC triple bonds or aromatic substances). The different functional groups require different temperatures and/or the addition of different chemicals for optimum dissolving and removal. The addition of chemicals in this context refers to the addition of detergents, rinse aid and/or enzymes.

The customization unit therefore customizes the washing parameters of the washing program based on the functional groups present.

According to one embodiment the washing parameters comprise a temperature of the washing water, a type of washing agent and/or a time when the washing agent is added.

The customization unit can then customize washing parameters of a current washing program based on the determined functional groups. The washing agent here can comprise a detergent (for example surfactants), enzymes (for example amylase, protease and/or lipase), rinse aid, bleach or the like. In particular different washing agents can be supplied at different times at different temperatures, depending on the functional groups determined.

According to a further embodiment the sensor is arranged in a sump of the water-conducting household appliance or in a bypass arrangement outside a wash container of the water-conducting household appliance.

If the sensor is arranged in the sump, it is positioned in a calm part of the washing liquor where a stable measurement is possible. Also the rotation speed can be set to a previously defined value during measurement if required. The sensor here can be protected from solid content by way of a type of filter system. The configuration of the hole size of the filter and the determination of the volumetric flow here in particular prevent solid content being deposited during the course of the washing cycle.

The sensor can also be positioned in a type of bypass. Different basic conditions can be established in the bypass compared with the inner chamber of the dishwasher. These include for example a defined flow speed (without the washing cycle being influenced by a drop in rotation speed) or the setting of an appropriate temperature. Such a bypass can lead from the output of the washing liquor storage unit into the sump below the filter for example.

According to a further embodiment the sensor is designed to perform spectroscopy, the spectroscopy being infrared spectroscopy, near infrared spectroscopy, Fourier transform infrared spectroscopy, electron absorption spectroscopy, microwave spectroscopy, nuclear magnetic resonance spectroscopy, mass spectroscopy or Raman spectroscopy.

The sensor used is designed to perform spectroscopy, in which radiation is broken down based on a specific property such as energy, wavelength, mass, etc. This allows spectral measurement values of organic compounds in the washing water to be acquired. The determination unit can determine the functional groups of the organic compounds based on these measurement values.

Spectroscopy can be performed in the manner of a transmission measurement or reflection measurement. In the case of a transmission measurement the radiation passing through the molecules, in other words organic compounds, present in the washing water is determined. During a reflection measurement the radiation reflected by the molecules is acquired. A combination of the two measurements is also possible.

The spectroscopy can be infrared spectroscopy or near infrared spectroscopy for example, these also being referred to in the following as IR or NIR. Depending on what is required, the full NIR range can be acquired or just individual specific wavelengths are measured and considered. These wavelengths are also referred to as spectral measurement values.

NIR is used inter alia in agriculture, food chemistry and pharmacy to determine for example the water, starch, fat, protein, alcohol content, sugar in food or medication. Molecules interact with electromagnetic radiation and absorb radiation. The emitted or reflected radiation can then be measured and provides information about organic compounds. Similar molecular spectroscopy methods include Raman spectroscopy, which also provides oscillation information in the infrared range, electron absorption spectroscopy in the higher frequency range or Fourier transform infrared spectroscopy (FTIR).

Spectroscopy allows the following functional groups of organic compounds inter alia to be determined: moisture (OH group), protein (proteins, amino groups, etc.), raw fiber (fiber, CH bond and others), carboxy groups (COOH) in plastics and fat content (CH bond).

According to a further embodiment the functional groups of proteins, fats and/or carbohydrates can be determined.

These functional groups are of interest when customizing the washing program, as they require different temperature ranges and types of washing agent for optimum removal.

According to a further embodiment the customization unit is designed to customize the washing parameters in such a manner that a cold prewash without alkalinity is performed, if the functional group of proteins is determined.

Proteins can be cleaned away optimally below their coagulation temperature—the temperature at which they start to denature (clustering of amino acids). This coagulation temperature is generally around 42° C. As a high pH value can also cause protein clumping, a cold washing liquor that only contains surfactants is optimal for soiling containing proteins. Therefore surfactants alone are added to the washing liquor initially.

According to a further embodiment the customization unit is designed to customize the washing parameters in such a manner that protease is added to the washing water, if the functional group of proteins is determined.

The protease allows proteins that are still present to be broken down and therefore removed more easily. The temperature of the washing water can be customized based on the added protease here.

According to a further embodiment the customization unit is designed to customize the washing parameters in such a manner that an alkaline agent is added to the washing water and a cold prewash with alkalinity is performed, if the functional group of carbohydrates is determined.

Thus for example a long, cold, prewash phase with a high pH value is expedient for soaking, in the case of soiling containing wheat starch that has not yet gelatinized, e.g. noodle dough. However if rice starch is present, such a prewash phase is pointless, as this is most effectively cleaned away at high temperatures with a high pH value. Therefore a cold prewash can be performed first with added alkaline agent depending on the type of carbohydrates present.

According to a further embodiment the customization unit is designed to customize the washing parameters in such a manner that amylase is added to the washing water, if the functional group of carbohydrates is determined.

The amylase allows carbohydrates, in other words starch, still present, to be broken down and removed more easily. The temperature of the washing water can be customized based on the added amylase here.

According to a further embodiment the customization unit is designed to customize the washing parameters in such a manner that lipase is added to the washing water, if the functional group of fats is determined.

The lipase allows fats that are present to be broken down and then be removed more easily. The temperature of the washing water can be customized based on the added lipase here.

According to a further embodiment the determination unit is designed to determine a gelatinization temperature of the carbohydrates, if the functional group of carbohydrates is determined.

The gelatinization temperature is the temperature at which the carbohydrates or starch swell, with the result that they can be attacked particularly effectively by amylases. In other words the amylases are most effective and can break the carbohydrates down optimally at the gelatinization temperature.

According to a further embodiment the customization unit is designed to customize the washing parameters in such a manner that the temperature of the washing water corresponds to the gelatinization temperature.

This allows the carbohydrates to be broken down and removed optimally.

According to a further embodiment the determination unit is designed to determine a melting temperature of the fats, if the functional group of fats is determined.

Fats differ in melting temperature for example. To clean away soiling containing fat, it is therefore favorable if the respective melting temperature is reached or exceeded. This is preferably achieved in conjunction with surfactants but with a neutral pH value, as the fats may otherwise saponify and therefore become difficult to dissolve. However if there are no fats with a high melting point present, heating takes up an unnecessarily large amount of energy and time.

According to a further embodiment the customization unit is designed to customize the washing parameters in such a manner that the temperature of the washing water corresponds to the melting temperature.

This allows the fats to be removed optimally depending on melting temperature. At the same time it means that the temperature of the washing water is not unnecessarily high, thereby reducing the energy required.

According to a further embodiment the washing program is performed in the following sequence, the individual steps being optional and a function of the determined functional group:

- cold prewash without alkalinity for soiling containing protein
- addition of alkaline agent
- cold prewash with alkalinity for soiling containing starch
- adjusting the temperature level to approx. 30° C. for enzymes (customized based on the optimum effective temperatures of the enzymes then used, if known)
- addition of amylase for soiling containing starch
- addition of protease for soiling containing protein
- addition of lipase for soiling containing fat
- adjusting the temperature level as a function of the gelatinization temperatures of the types of starch determined to clean away already gelatinized soiling containing starch (for example in the case of cooked noodles)
- if not already done, adjusting to a temperature level that is higher than the highest melting temperature of the fats detected
- when the cleaning operation has been completed, bleach can be added, the quantity of detected staining soiling being determined. A basic quantity is already added for hygiene purposes.

There may be no need for an intermediate wash if there is no fat or starch present. There was then only alkalinity and bleach in the washing liquor. Also, depending on the drying system, the final rinse may be cold, it no longer being necessary for the final cleaning away of fat.

A water-conducting household appliance is also proposed, which has a device as described above for customizing a washing program for removing soiling from items being washed in the water-conducting household appliance.

According to one embodiment the water-conducting household appliance is a dishwasher or washing machine.

A method for customizing a washing program for removing soiling from items being washed in a water-conducting household appliance is also proposed. The method has the following steps: acquiring spectral measurement values of organic compounds in the washing water in the water-conducting household appliance, determining functional groups of the organic compounds based on the acquired spectral measurement values of the organic compounds and customizing washing parameters of a current washing program based on the determined functional groups.

The embodiments and features described for the proposed device apply correspondingly to the proposed method.

A computer program product is also proposed, which initiates the performance of the method as described above on a program-controlled facility.

A computer program product, for example a computer program means, can be provided or supplied for example as a storage medium, for example a memory card, USB stick, CD-ROM, DVD or in the form of a file that can be downloaded from a server in a network. This can be done for example in a wireless communication network by transferring a corresponding file containing the computer program product or computer program means.

Further possible implementations of the invention comprise combinations of features or embodiments described above or in the following with regard to the exemplary embodiments even if these are not cited specifically. The person skilled in the art will also add individual aspects to improve or complete the respective basic form of the invention.

BRIEF DESCRIPTION OF THE DRAWINGS

Further advantageous configurations and aspects of the invention are set out in the subclaims and the exemplary embodiments of the invention described in the following. The invention is also described in more detail based on preferred embodiments with reference to the accompanying figures.

DETAILED DESCRIPTION OF EXEMPLARY EMBODIMENTS OF THE PRESENT INVENTION

Figure 1:
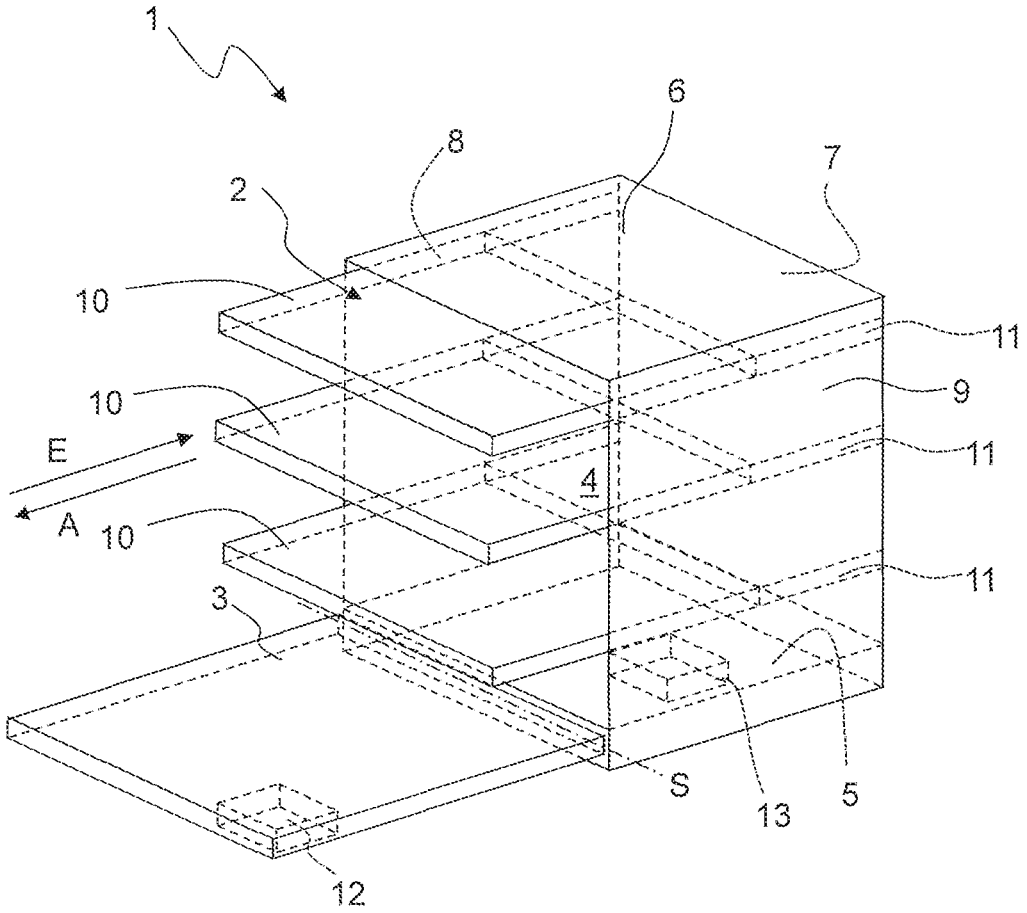
FIG. 1 shows a perspective view of an embodiment of a water-conducting household appliance.

Identical elements or those of identical function are shown with the same reference characters in the figures, unless otherwise specified.

FIG. 1 shows a perspective view of a first embodiment of a water-conducting household appliance 1, in particular a dishwasher or washing machine. A dishwasher is described by way of example in the following. The described elements and functions can be applied to a washing machine, where appropriate.

The dishwasher 1 has a carcass comprising a wash container 2 and a door 3. The wash container 2 and door 3 form a wash chamber 4 for washing items to be washed. The door 3 is shown in its opened position in FIG. 1. The door 3 can be closed or opened by pivoting about a pivot axis S provided at a lower end of the door 3.

The wash container 2 is box-shaped for example and can comprise a base 5, a top 6 positioned opposite the base 5, a rear wall 7 positioned opposite the door 3 and two opposing side walls 8, 9. The side walls 8, 9 in particular can be made of stainless steel.

The dishwasher 1 also has at least one load level 10. The at least one load level 10 is preferably a receptacle for items to be washed in the dishwasher 1. A number of load levels 10 in particular can be provided, comprising a lower rack, an upper rack and/or a flatware drawer. The several load levels 10 are preferably arranged one above the other in the wash container 2. Each load level 10 can be moved as required into the wash container 2 in an insertion direction E or out of it in a pull-out direction A. A rail 11 is preferably provided on both sides of a respective load level 10 for this purpose.

A control device 12, provided optionally in the carcass or in the door 3 of the dishwasher 1, is designed to control the progress of washing programs for washing items being washed. The control device 12 can comprise a device 12 for customizing a washing program for removing soiling from items being washed, as described for example in FIG. 2.

A sensor 13 is also shown, which can be deployed at different points in the dishwasher 1. The sensor 13 serves to perform spectroscopy, in order to detect organic compounds in the washing water of the dishwasher 1.

The control device 12 is designed to control the sensor 13 and optionally a number of further sensors and/or actuators of the household appliance 1.

Figure 2:
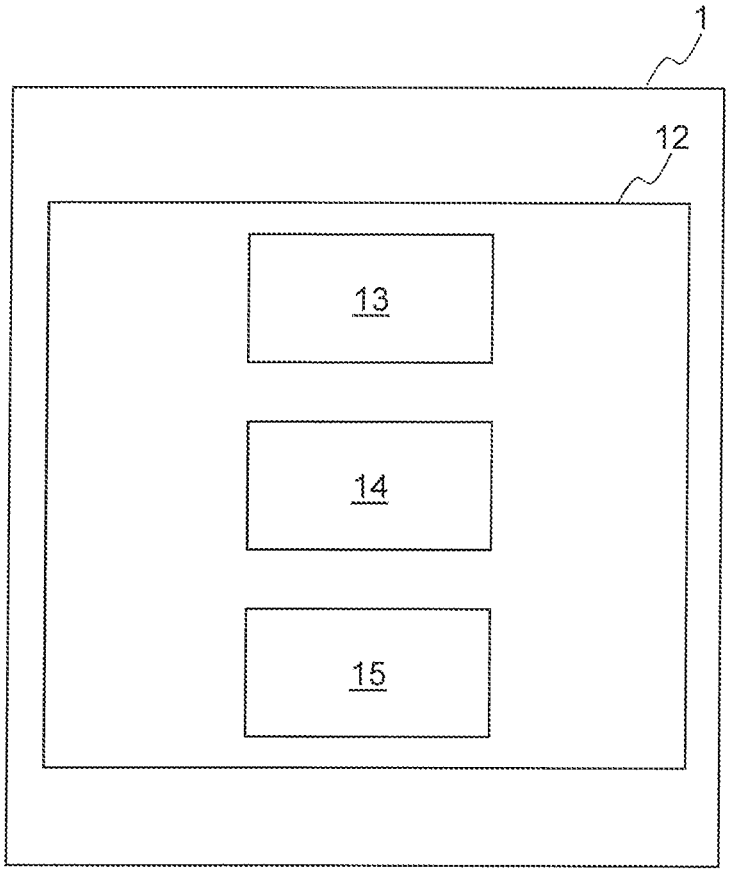
FIG. 2 shows a schematic block diagram of an embodiment of a device for customizing a washing program for removing soiling from items being washed in the water-conducting household appliance.

FIG. 2 shows a schematic block diagram of an embodiment of a device 12 for customizing a washing program for removing soiling from items being washed in the water-conducting household appliance, for example a dishwasher 1.

The device 12 has a sensor 13, a determination unit 14 and a customization unit 15.

The sensor 13 performs spectroscopy, for example near infrared spectroscopy to detect organic compounds in the form of spectral measurement values in the washing liquor of the dishwasher 1. The determination unit 14 can determine functional groups of the organic compounds based on the acquired spectral measurement values of the organic compounds.

The customization unit 15 can use the information about the functional groups to customize washing parameters of a current washing program or to customize stored washing programs already available. The customization unit 15 can also customize automatic dosing by a dosing unit (not shown).

The customization unit 15 can be used to customize the individual program steps of the washing program with regard to temperature and the washing agent used based on the functional groups present.

Figure 3:
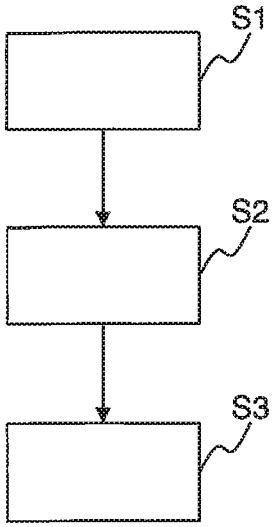
FIG. 3 shows an exemplary embodiment of a method for customizing a washing program for removing soiling from items being washed in the water-conducting household appliance.

FIG. 3 shows an exemplary embodiment of a method for customizing a washing program for removing soiling from items being washed in the water-conducting household appliance 1.

In step S1 spectral measurement values of organic compounds in the washing water in the water-conducting household appliance 1 are acquired.

In step S2 functional groups of the organic compounds are determined based on the acquired spectral measurement values of the organic compounds.

Then in step S3 washing parameters of a current washing program are customized based on the determined functional groups.

Figure 4:
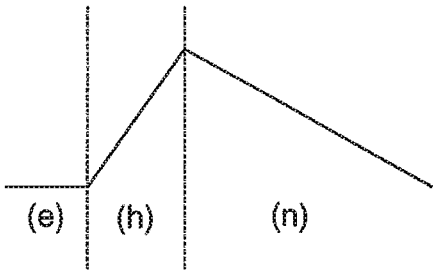
FIG. 4 shows a first exemplary embodiment of a cleaning segment of a washing program for removing soiling from items being washed in the water-conducting household appliance.

FIG. 4 shows a first exemplary embodiment of a cleaning segment of a washing program for removing soiling from items being washed in the water-conducting household appliance 1.

A washing program can be as follows for example, the individual steps being optional depending on the functional groups present:

According to a further embodiment the washing program is performed in the following sequence, the individual steps being optional and a function of the determined functional groups:

(a) cold prewash without alkalinity for soiling containing protein
(b) addition of alkaline agent
(c) cold prewash with alkalinity for soiling containing starch
(d) adjusting the temperature level to approx. 30° C. for enzymes (customized based on the optimum effective temperatures of the enzymes then used, if known)
(e) addition of amylase for soiling containing starch
(f) addition of protease for soiling containing protein
(g) addition of lipase for soiling containing fat
(h) adjusting the temperature level as a function of the gelatinization temperatures of the types of starch determined to clean away already gelatinized soiling containing starch (for example in the case of cooked noodles)
(i) if not already done, adjusting to a temperature level that is higher than the highest melting temperature of the fats detected
(j) when the cleaning operation has been completed, bleach can be added, the quantity of detected staining soiling being determined. A basic quantity is already added for hygiene purposes.

Steps (a) to (c) serve as the prewash, steps (d) to (i) are the cleaning segment of the washing program and step (j) is a final rinse operation for hygiene purposes. Further final rinse and drying segments can optionally follow.

FIG. 4 shows a diagram of a cleaning segment, in which only the functional group of carbohydrates from rice has been determined. In this instance it is sufficient to perform steps (e) and (h) for the cleaning segment. Amylase is first optionally added in step (e) and then in step (h) the temperature is increased to 70° C., as this corresponds to the gelatinization temperature of rice. The temperature can then be lowered again, as shown by step (n).

Figure 5:
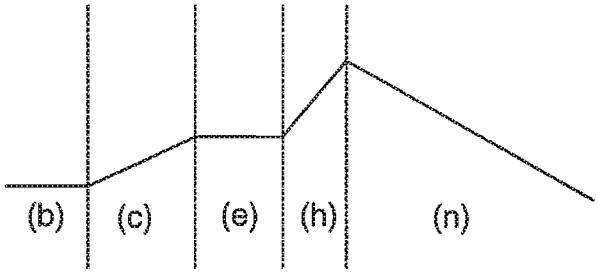
FIG. 5 shows a second exemplary embodiment of a cleaning segment of a washing program for removing soiling from items being washed in the water-conducting household appliance.

FIG. 5 shows a second exemplary embodiment of a cleaning segment of a washing program for removing soiling from items being washed in the water-conducting household appliance. Only the functional group of carbohydrates from flour, for example processed flour in the form of noodles, was determined here.

It is therefore expedient first to perform a cold soak with an alkaline agent (steps (b) and (c)). Amylase is then added in step (e) and the temperature is increased to 30° C., as amylase is most effective at this temperature. The temperature is then increased further to 59° C. in step (h), as this corresponds to the gelatinization temperature of flour. The temperature can then be lowered again, as shown by step (n).

These cleaning segments can be customized based on the functional groups present.

Although the present invention has been described based on exemplary embodiments, it can be modified in many different ways.

REFERENCE CHARACTERS USED

1 Water-conducting household appliance
2 Wash container
3 Door
4 Wash chamber
5 Base
6 Top
7 Rear wall
8, 9 Side walls
10 Load level
11 Rail
12 Control device (device for determining soiling)
13 Sensor
14 Determination unit
15 Customization unit
A Pull-out direction
E Insertion direction
S Pivot axis
S1-S2 Method steps
(a)-(n) Cleaning segments

The invention claimed is:

1. A device for customizing a washing program for removing soiling from items being washed in a water-conducting household appliance, said device comprising:

a sensor configured to acquire spectral measurement values of organic compounds in washing water in the water-conducting household appliance, the sensor being arranged in a sump of the water-conducting household appliance or in a bypass arrangement outside a wash container of the water-conducting household appliance;

a determination unit configured to determine functional groups of the organic compounds including proteins, fats and/or carbohydrates based on the acquired spectral measurement values of the organic compounds; and a customization unit configured to customize washing parameters of a current washing program based on the determined functional groups, wherein the washing parameters comprise at least a temperature of the washing water, a type of washing agent, and a time when the washing agent is added, wherein the customization unit is configured to customize individual program steps of the washing program with regard to the temperature of the washing water and the type of washing agent used based on the determined functional groups present, wherein the customization unit is configured to customize automatic dosing of the washing agent based on the determined functional groups present, and wherein the sensor is configured to perform a spectroscopy selected from the group consisting of infrared spectroscopy, near infrared spectroscopy, Fourier transform infrared spectroscopy, electron absorption spectroscopy, microwave spectroscopy, nuclear magnetic resonance spectroscopy, mass spectroscopy, and Raman spectroscopy.

2. The device of claim 1, wherein the customization unit is configured to customize the washing parameters in such a manner that a cold prewash without alkalinity is performed, when the functional group of proteins is determined.

3. The device of claim 1, wherein the customization unit is configured to customize the washing parameters in such a manner that protease is added to the washing water, when the functional group of proteins is determined.

4. The device of claim 1, wherein the customization unit is configured to customize the washing parameters in such a manner that an alkaline agent is added to the washing water and a cold prewash with alkalinity is performed, when the functional group of carbohydrates is determined.

5. The device of claim 1, wherein the customization unit is configured to customize the washing parameters in such a manner that amylase is added to the washing water, when the functional group of carbohydrates is determined.

6. The device of claim 1, wherein the customization unit is configured to customize the washing parameters in such a manner that lipase is added to the washing water, when the functional group of fats is determined.

7. The device of claim 1, wherein the determination unit is configured to determine a gelatinization temperature of the carbohydrates, when the functional group of carbohydrates is determined.

8. The device of claim 7, wherein the customization unit is configured to customize the washing parameters in such a manner that the temperature of the washing water corresponds to the gelatinization temperature.

9. The device of claim 1, wherein the determination unit is configured to determine a melting temperature of the fats, when the functional group of fats is determined.

10. The device of claim 9, wherein the customization unit is configured to customize the washing parameters in such a manner that the temperature of the washing water corresponds to the melting temperature.

11. A water-conducting household appliance, comprising a device for customizing a washing program for removing soiling from items being washed in the water-conducting household appliance, said device comprising a sensor configured to acquire spectral measurement values of organic compounds in washing water in the water-conducting household appliance, the sensor being arranged in a sump of the water-conducting household appliance or in a bypass arrangement outside a wash container of the water-conducting household appliance, a determination unit configured to determine functional groups of the organic compounds including proteins, fats and/or carbohydrates based on the acquired spectral measurement values of the organic compounds, and a customization unit configured to customize washing parameters of a current washing program based on the determined functional groups, wherein the washing parameters comprise at least a temperature of the washing water, a type of washing agent, and a time when the washing agent is added, wherein the customization unit is configured to customize individual program steps of the washing program with regard to the temperature of the washing water and the type of washing agent used based on the determined functional groups present, wherein the customization unit is configured to customize automatic dosing of the washing agent based on the determined functional groups present, and wherein the sensor is configured to perform a spectroscopy selected from the group consisting of infrared spectroscopy, near infrared spectroscopy, Fourier transform infrared spectroscopy, electron absorption spectroscopy, microwave spectroscopy, nuclear magnetic resonance spectroscopy, mass spectroscopy, and Raman spectroscopy.

12. The water-conducting household appliance of claim 11, wherein the customization unit is configured to customize the washing parameters in such a manner that a cold prewash without alkalinity is performed, when the functional group of proteins is determined.

13. The water-conducting household appliance of claim 11, wherein the customization unit is configured to customize the washing parameters in such a manner that protease is added to the washing water, when the functional group of proteins is determined.

14. The water-conducting household appliance of claim 11, wherein the customization unit is configured to customize the washing parameters in such a manner that an alkaline agent is added to the washing water and a cold prewash with alkalinity is performed, when the functional group of carbohydrates is determined.

15. The water-conducting household appliance of claim 11, wherein the customization unit is configured to customize the washing parameters in such a manner that amylase is added to the washing water, when the functional group of carbohydrates is determined.

16. The water-conducting household appliance of claim 11, wherein the customization unit is configured to customize the washing parameters in such a manner that lipase is added to the washing water, when the functional group of fats is determined.

17. The water-conducting household appliance of claim 11, wherein the determination unit is configured to determine a gelatinization temperature of the carbohydrates, when the functional group of carbohydrates is determined.

18. The water-conducting household appliance of claim 17, wherein the customization unit is configured to customize the washing parameters in such a manner that the temperature of the washing water corresponds to the gelatinization temperature.

19. The water-conducting household appliance of claim 11, wherein the determination unit is configured to determine a melting temperature of the fats, when the functional group of fats is determined.

20. The water-conducting household appliance of claim 19, wherein the customization unit is configured to customize the washing parameters in such a manner that the temperature of the washing water corresponds to the melting temperature.

21. A method for customizing a washing program for removing soiling from items being washed in a water-conducting household appliance, said method comprising:

acquiring spectral measurement values of organic compounds in washing water in the water-conducting household appliance using a sensor, the sensor being arranged in a sump of the water-conducting household appliance or in a bypass arrangement outside a wash container of the water-conducting household appliance;

determining functional groups of the organic compounds including proteins, fats and/or carbohydrates based on the acquired spectral measurement values of the organic compounds; and customizing washing parameters of a current washing program based on the determined functional groups, wherein the washing parameters comprise at least a temperature of the washing water, a type of washing agent, and a time when the washing agent is added, wherein the customizing comprises customizing individual program steps of the washing program with regard to the temperature of the washing water and the type of washing agent used based on the determined functional groups present, wherein the customizing comprises customizing automatic dosing of the washing agent based on the determined functional groups present, and wherein the sensor is configured to perform a spectroscopy selected from the group consisting of infrared spectroscopy, near infrared spectroscopy, Fourier transform infrared spectroscopy, electron absorption spectroscopy, microwave spectroscopy, nuclear magnetic resonance spectroscopy, mass spectroscopy, and Raman spectroscopy.

* * * * *